United States Patent [19]

Smit et al.

[11] Patent Number: 4,713,086

[45] Date of Patent: Dec. 15, 1987

[54] OIL-COMPATIBLE COAL/WATER MIXTURES

[75] Inventors: Francis J. Smit, Arvada; William E. Horst; Anirudh K. Bhasin, both of Golden, all of Colo.

[73] Assignee: Amax Inc., Greenwich, Conn.

[21] Appl. No.: 585,661

[22] Filed: Mar. 2, 1984

[51] Int. Cl.[4] ..... C10L 1/32

[52] U.S. Cl. ..... 44/51; 44/77; 252/351

[58] Field of Search ..... 44/51, 56, 77; 252/351

[56] References Cited

U.S. PATENT DOCUMENTS

| | | | |
|---|---|---|---|
| 3,210,168 | 10/1965 | Morway | 44/51 |
| 4,153,421 | 5/1979 | Marlin | 44/51 |
| 4,195,975 | 4/1980 | Hamuro et al. | 44/51 |
| 4,203,729 | 5/1980 | Ishizaki et al. | 44/51 |
| 4,251,229 | 2/1981 | Naka et al. | 44/51 |
| 4,282,006 | 8/1981 | Funk | 44/51 |
| 4,358,293 | 11/1982 | Mark | 44/51 |

FOREIGN PATENT DOCUMENTS

| | | | |
|---|---|---|---|
| WO83/0005-00 | 2/1983 | European Pat. Off. | 44/51 |

OTHER PUBLICATIONS

"Coal: Diesel Fuel of the Future?", *Power*, Mar. 1982, vol. 125, pp. 43–44.

Excerpts from Fifth International Symposium on Coal Slurry Combustion & Techology, Apr. 25–27, 1983, Tampa, Fla., vol. 1 & 2, pp. (I–IV, 2–4 and 7–24).

*Primary Examiner*—William R. Dixon, Jr.

*Assistant Examiner*—Margaret B. Medley

*Attorney, Agent, or Firm*—Michael A. Ciomek; Eugene J. Kalil

[57] ABSTRACT

A method is provided for inhibiting an increase in viscosity of coal/water slurries when such slurries are caused to contact petroleum oil during fuel changeover in power generation systems, the method comprising maintaining in the coal/water slurry during transitional contact with petroleum oil an effective amount of an agglomeration-inhibiting agent selected from the group consisting of nonionic and anionic dispersing agents sufficient to inhibit the formation of coal/oil agglomerates and provide a flowable mixture during transitional contact having a Brookfield viscosity of below about 50,000 cP.

13 Claims, No Drawings

OIL-COMPATIBLE COAL/WATER MIXTURES

This invention relates to improved coal/water mixtures for fuel and, in particular, to oil-compatible coal/water mixtures.

BACKGROUND OF THE PRIOR ART

Slurries of coal/water mixtures comprising finely ground coal dispersed in water have been found to be useful as fuels in place of petroleum in steam boilers and thermal engines, such as diesel engines. (Fifth International Symposium on Coal Slurry Combustion and Technology Center, Apr. 25–27, 1983; note also "Coal: Diesel Fuel of the Future?" by John Dunlay, *Power*, Vol. 125, No. 3, March 1981, pp. 43–44).

According to U.S. Pat. No. 4,282,006, grinding requirement and additives needed to produce stable slurries of acceptable viscosities and coal contents are well established. In the patent, the background of the prior art is discussed in quite some detail and, as to the relevant prior art discussed therein, the disclosure of said patent is incorporated herein by reference.

In some applications, such as in diesel engines, it may be desirable, for example, to switch from one type of fuel (e.g., diesel oil) to another, such as coal/water mixtures, which is referred to herein as CWM. Because petroleum oils, such as No. 2 diesel fuel, are more easily ignited than coal slurries, the diesel engines are best started with petroleum oil followed by switching over to CWM fuel soon after the engine is started and finally back to oil shortly before stopping the engine. During the switch-over periods, the two types of fuels must be compatible during transitional mixing since the flow of both fuels is necessarily through the same pipelines feeding the combustion chamber of the engine.

The usual formulations of the coal/water mixture are not compatible with oil. When mixed with No. 2 diesel fuel or with No. 6 fuel oil, these CWM fuels form exceedingly high-viscosity masses of agglomerated coal. Viscosities of 400,000 to 640,000 centipoise have been measured for these masses. Such masses can clog lines and orifices. The reason for this agglomeration is that coal surfaces are normally hydrophobic and oleophillic. Any oil added to the system displaces water from the coal surfaces and binds the coal particles tightly together. The dispersants ordinarily added to the coal/water mixtures (such as Diamond-Shamrock A-23) are active enough to overcome the hydrophobic nature of the coal sufficiently so that low-viscosity coal-water mixtures form but these dispersants are not powerful enough to overcome the oleophillic nature of the coal.

It would be desirable to provide a coal/water mixture that can be mixed with petroleum, such as fuel oil, without causing the powdered coal to agglomerate and raise the viscosity of the mixture to unacceptable levels.

OBJECTS OF THE INVENTION

One object of the invention is to provide a coal/water mixture which is oil-compatible.

Another object is to provide a coal/water mixture which can be mixed with petroleum oils under conditions that inhibit the formation of agglomerated powdered coal and provide acceptable viscosity levels.

These and other objects will more clearly appear when taken in conjunction with the following disclosure and the appended claims.

SUMMARY OF THE INVENTION

It has been found that the addition of certain nonionic and anionic dispersing reagents to coal/water slurries greatly inhibits the formation of undesirable high-viscosity agglomerates when such slurries are mixed with petroleum oil. The suitable nonionic reagents are organic compounds containing a plurality of ether groups (—O—) and/or hydroxyl groups (—OH) such as ethoxylated hydrocarbons and polysaccharides. Anion-forming substitutions in place of or in addition to the hydroxyl group, such as $SO_4$, are also acceptable provided any organic ion which may form in aqueous solution are negatively charged. It is thought that any of these compounds adsorb onto the coal particle surface causing it to become oleophobic rather than oleophillic. Other explanations are possible, for example, some reagents such as these are potent emulsifiers for oil-water systems as well.

In carrying the invention to practice, the coal is first treated to remove its ash content to below about 5% and preferably below about 1% or 0.5% by weight. Thus, stating it broadly, the method resides in providing particulate coal of particle size less than about 300 microns, e.g., less than about 74 microns, such as less than about 44 microns or less than about 20 microns, which coal has been physically and/or chemically cleaned of its ash content. The method comprises forming a coal/water mixture thereof, adding to the mixture an effective amount of a coal agglomeration-inhibiting agent selected from the group consisting of anti-agglomerating nonionic and anionic dispersants for rendering the coal oleophobic, and mixing the dispersant with the coal/water mixture, such that when the mixture is contacted by petroleum oil, the agglomerating tendency of the oil and coal is substantially inhibited due to the presence of the anti-agglomerating agent. When mixed with oil, the resulting oil-coal/water slurry is flowable and has a substantially low viscosity of less than about 50,000 cP as measured with the Brookfield viscosimeter using a "T-E Spindle" at 5 rpm, generally less than about 25,000 cP, e.g., less than about 15,000 cP.

DETAILS OF THE INVENTION

Tests were conducted using CWM (coal/water mixtures) formulations with and without agglomeration-inhibiting agents. The CWM used in the experiments were prepared using bituminous coal obtained from a coal seam in West Virginia referred to as the Sewell seam. The mixture contained 58.5% by weight air dried coal and 0.9% of a dispersant identified as A-23 (an ammonium naphthalene sulfonate manufactured by Diamond-Shamrock Corporation), the balance of the mixture being water. The mixture was ground in a Union Process Company Model 1-S Attritor to particle sizes less than 30 microns and exhibited a viscosity of 1200 centipoise (cP) when measured with the "T-B Spindle" of a Brookfield Model RVT viscometer with a helipath stand, using a speed of mixing of 5 rpm.

The coal had been previously cleaned to an ash level of less than about 2.5% by weight. Samples of the CWM were mixed with either No. 2 diesel fuel or No. 6 fuel oil, these oils having the following characteristics:

| Fuel | Specific Gravity | Viscosity |
|---|---|---|
| No. 2 Diesel Fuel | 33° API | 34 Saybolt Universal |

-continued

| Fuel | Specific Gravity | Viscosity |
|---|---|---|
| No. 6 Fuel Oil | 26° API | Seconds at 100° F. 250 Saybolt Furol Seconds at 122° F. |

The mixing was carried out either by stirring in a beaker by hand with a spatula or else under high intensity conditions in a Waring blender. The initial viscosity of the No. 2 diesel fuel was less than 80 cP using the "T-B Spindle" as described hereinabove and the viscosity of the No. 6 fuel oil was 12,000 cP.

Eight experiments were conducted using a dispersant identified as 9N9, an ethoxylated nonylphenol formerly manufactured by the Dow Chemical Company, the dispersant being added to the CWM prior to stirring with the oils. This dispersant is ethoxylated to provide 9 moles ethoxy groups (—$CH_2$—$CH_2$—O—) per mole of compound. Another dispersant employed is a 10% solution of Stadex 120 (trademark), a corn dextrin manufactured by A. E. Staley Co., the dextrin being characterized by the general formula $(C_6H_{10}O_5)_x$.

A compound referred to by the trademark Arosurf MG-2083A (a tridecyl ether diamine acetate produced by the Sherex Chemical Company) and Sipon LSB (trademark), a 29% solution of sodium lauryl sulfate produced by Alcolac, Inc. were used in two separate experiments as representatives of cationic and anionic organic compounds, respectively.

The following experiments were conducted:

1. About 10 percent by volume No. 2 diesel fuel was stirred vigorously by hand into 100 ml of CWM. The oily layer initially on top was replaced by gummy masses distributed in the slurry.
2. 300 ml of No. 2 diesel fuel was stirred vigorously by hand into 300 ml of CWM. The lower CWM layer quickly congealed into a cohesive mass with a viscosity in centipoise of 640,000 cP ("T-E Spindle"). An oily layer covered the CWM mass.
3. Experiment 1 was repeated except 10 percent by volume No. 6 fuel oil was added in place of No. 2 diesel fuel. Results were similar.
4. Experiment 2 was repeated except an equal volume of No. 6 fuel oil was added in place of the No. 2 diesel fuel. Hand stirring produced a uniform mass with a viscosity of 400,000 cP ("T-E Spindle").
5. Experiment 1 was repeated with about 300 ml CWM except 0.4 percent 9N9 was mixed thoroughly into the CWM before adding 10 percent by volume No. 2 diesel fuel. Hand stirring produced a uniform fluid mixture which remained fluid after mixing in the Waring blender for 1 minute.
6. Experiment 5 was repeated except 10 percent by volume No. 6 fuel oil was added in place of the No. 2 diesel fuel. Hand stirring produced a fluid mixture of CWM and oil drops but mixing in the Waring blender produced a uniform but more viscous fluid. The addition of 1 percent 9N9 to the mixture and remixing in the blender produced a much less viscous mixture.
7. Experiment 2 was repeated except 0.4 percent 9N9 was first mixed with the CWM. The No. 2 diesel fuel and CWM layers remained fluid and separate even after prolonged hand stirring. The viscosity of the oil layer remained less than 80 cP while the viscosity of the bottom CWM layer increased to 7300 cP ("T-B Spindle"). Mixing 30 seconds in the Waring blender produced an agglomerated mass beneath an oil layer.
8. Experiment 7 was repeated except an equal volume of No. 6 fuel oil was added in place of the No. 2 diesel fuel oil. An agglomerated mass with viscosity of 150,000 cP ("T-E Spindle") formed rapidly during the hand stirring. Mixing with the Waring blender for 30 seconds produced a uniform paste with a viscosity of 700,000 cP ("T-E Spindle").
9. Experiment 7 was repeated except the amount of 9N9 added was increased to 1.8 percent. Hand stirring quickly produced a uniform mixture with a viscosity of 116,000 cP ("T-E Spindle").
10. Experiment 9 was repeated except an equal volume of No. 6 fuel oil was used in place of the No. 2 diesel fuel. Hand stirring quickly produced a uniform mixture with a viscosity of 116,000 cP ("T-E Spindle").
11. Experiment 7 was repeated except the amount of 9N9 added was increased to 4.5 percent. A uniform mixture of viscosity 42,000 cP ("T-E Spindle") formed rapidly during hand stirring.
12. Experiment 11 was repeated except an equal volume of No. 6 fuel oil was used in place of the No. 2 diesel fuel. A uniform mixture of viscosity 48,000 cP ("T-E Spindle") formed rapidly by hand stirring. Mixing in a Waring blender for 30 seconds increased the viscosity to 91,000 cP.
13. Experiment 2 was repeated but 1 percent by weight Stadex 120 was first mixed with the CWM before stirring with the No. 2 diesel fuel. Hand stirring produced a grainey but fluid mixture. A thin layer of oil appeared upon standing for several days and the major portion of the mixture also appeared to have separated into layers. The viscosity of the upper layer was 10,000 cP ("T-E Spindle") and the viscosity of the lower layer was 14,000 cP.
14. Experiment 13 was repeated except an equal volume of No. 6 fuel oil was used in place of the No. 2 diesel fuel. Hand stirring produced a mixture of water and large oil drops. The mixture separated into layers upon standing for several days. The viscosity of the top layer was 10,000 cP ("T-E Spindle") and the viscosity of the bottom layer was 5,000 cP ("T-E Spindle"). Stirring 30 seconds in the Waring blender produced a uniform mixture of 270,000 cP ("T-E Spindle").
15. One percent by weight of MG-2083A was added to the CWM. The CWM congealed into a solid mass.
16. One percent by weight of Sipon LSB was mixed with 300 ml CWM. 300 ml of No. 6 fuel oil was next stirred into the CWM by hand. Vigorous stirring produced a mixture of CWM and oil drops which separated overnight into layers. The viscosity of the top oily layer was 26,000 cP ("T-E Spindle") while the viscosity of the bottom layer was 1700 cP ("T-B Spindle"). The layers remixed easily and the resulting mixture had a viscosity of 3600 cP ("T-B Spindle"). The mixture was mixed in a Waring blender for 30 seconds and it turned into a soft mass with a viscosity of 290,000 cP ("T-E Spindle") surrounded by oil.

Table 1 is a summary of those experiments where the viscosity of the CWM was measured after stirring with the oil:

TABLE 1

| Viscosity of Coal-Bearing Component After Hand Stirring | | |
|---|---|---|
| | Centipoise with Brookfield "T-E Spindle" at 5 RPM | |
| Agglomeration Inhibitor | No. 2 Diesel Fuel | No. 6 Fuel Oil |
| None | 640,000 | 400,000 |
| 0.4% 9N9 | 10,000 | 150,000 |
| 1.8% 9N9 | 116,000 | 116,000 |
| 4.5% 9N9 | 42,000 | 48,000 |
| 1.0% Stadex 120 | 14,000 | 10,000 |
| 1.0% Sipon LSB | — | 26,000 |

It can be seen that use of the nonionic and anionic agglomeration inhibitors substantially improved the compatibility of the CWM and the hydrocarbon fuels by lowering the viscosity of the mixture resulting from mixing under average conditions such as would be encountered in pipelines and storage tanks. The benefits of the dextrin and lauryl sulfate for such applications are clear. The ethoxylated nonylphenol is a much more powerful reagent and can completely emulsify the CWM except when used at low concentrations with No. 2 diesel fuel as in Experiment 7. Complete emulsification is less desirable since the viscosity of the mixture can be much higher than in cases where the CWM and oil are dispersed as coarse drops of one fluid in the other fluid.

The preference for less powerful reagents is no longer true under conditions of prolonged high intensity mixing as shown by the data in Table 2 following:

TABLE 2

| Viscosity Of Coal-Bearing Component After 30 Seconds Of High Intensity Mixing | |
|---|---|
| Agglomeration Inhibitor | cP, w/Brookfield "T-E Spindle" at 5 rpm No. 6 Fuel Oil |
| None | 400,000 |
| 0.4% 9N9 | 700,000 |
| 4.5% 9N9 | 91,000 |
| 1.0% Stadex 120 | 270,000 |
| 1.0% Sipon LSB | 290,000 |

Only the 4.5 percent 9N9 inhibitor was sufficient to prevent formation of a high-viscosity mass. The mixture containing 4.5% 9N9 would flow from the Waring blender container under its own accord, whereas the others did not.

Because in practice the mixing of CWM and the hydrocarbon fuels will only occur at certain times, indications are that it would be more economical if the inhibitor were added to the CWM only during the transition period shortly before and after the switch from CWM to hydrocarbon fuel or vice versa when preparing the CWM for use in thermal engines, steam boiler furnaces and the like. One may also find it useful to add the inhibitor to the CWM during other periods when it is necessary to soften and expeditiously remove agglomerated coal/oil masses from an operating system.

In producing the coal-slurry fuels of the invention, it is important that the coal be cleaned of its ash content. Thus, a series of coal-slurry fuels can be prepared by using coals of different ash contents obtained by sequentially upgrading a parent coal employing coarse and fine coal beneficiating, as well as chemical cleaning processes. The coal-cleaning sequent would include the following procedures:

(a) Run-of-mine coal is processed by conventional coal cleaning processes (e.g., heavy media separation) to produce conventional clean coal containing up to 10% by weight of ash.

(b) The cleaned coal is then ground and beneficiated using fine mineral beneficiation methods (e.g., flotation) to reduce the ash content to about 2% to 5% by weight.

(c) The coal from step 2(b) would then be leached to reduce the ash content to a level below 0.5% by weight using chemical cleaning systems known in the art.

The finally cleaned product would then be used to produce coal-slurry fuels for industrial and utility boilers, for thermal engines, such as diesel engines, gas turbines, as well as for feed for synthetic fuels.

With respect to utility steam boilers, the particle size of the coal may range up to less than about 300 microns, the amount of coal in the slurry ranging from about 45% to 75% by weight of slurry, preferably about 55% to 70%, e.g., about 55% to 65%. A preferred particle size of coal is less than about 74 microns.

With regard to thermal engines, such as diesel engines and gas turbines, the particle size of the coal in the slurry should be less than about 44 microns and, more preferably, below 20 microns to avoid clogging in the orifices feeding the fuel to the engine and permit complete combustion of the particles in a short time, the amount of coal in the slurry being the same as that stated hereinabove.

The amount of agglomeration-inhibiting agent added to the slurry should be sufficient to maintain the viscosity at an acceptable level when the slurry is contacted by petroleum oil and mixed therewith during changeover from one type of fuel to another, the viscosity being maintained at below about 50,000 cP, such as below 25,000 cP, and preferably below 15,000 cP. The amount of dispersant added should be at least about 0.2% by weight, so long as the amount added will maintain the viscosity in centipoise to below 50,000 cP as measured with Brookfield "T-E Spindle" at 5 rpm.

As stated herein, the dispersing agent may be used as an additive to decrease the viscosity of a coal/water slurry containing coal/oil masses in amounts which adversely affect the flowability of the slurry. Thus, by adding an effective amount of the agglomeration-inhibiting agent to the slurry, the agglomerated coal/oil masses can be softened and dispersed to decrease the viscosity and to improve the flowability of the slurry. This method is applicable for the treatment of slurries containing coal of sizes disclosed hereinbefore for use in power generation systems, such as thermal, engines, utility steam boilers and the like.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method for inhibiting the increase in viscosity of a coal/water slurry when brought into transitional contact with petroleum oil during fuel changeover while operating, a power generation system in which the changeover occurs from petroleum oil to coal/water slurry or from coal/water slurry to petroleum oil which comprises, causing transitional contact to occur between said coal/water slurry and said petroleum oil during fuel changeover in a power generation system while maintaining in said coal/water slurry during transitional contact with petroleum oil an effective amount of at least about 0.2% by weight of an agglomeration-inhibiting agent selected from the group consisting of nonionic and anionic dispersing agents, the amount being sufficient to thereby inhibit the formation of coal/oil agglomerates and provide a flowable mixture during transitional contact characterized by a Brookfield viscosity of less than about 50,000 cP, and continuing to operate said power generation system following fuel changeover.

2. The method of claim 1, wherein the coal/water slurry contains about 45% to 75% by weight of coal, and wherein said coal has a particle size of less than about 300 microns and an ash content of less than about 5% by weight.

3. The method of claim 2, wherein said effective amount of agglomeration-inhibiting agent is selected from the group consisting of polysaccharides, ethoxylated nonylphenol and sodium lauryl sulfate.

4. The method of claim 3, wherein the power generation system is a utility steam boiler and wherein the particle size of the coal in the slurry is less than about 300 microns.

5. The method of claim 2, wherein the power generation system is a thermal engine, wherein the particle size of the coal is less than about 44 microns and wherein the ash content thereof is less than about 1%.

6. The method of claim 5, wherein the particle size of the coal is less than about 20 microns.

7. The method of claim 1, wherein the coal/water slurry contains about 55% to 70% by weight of coal and wherein the particle size of the coal is less than 74 microns.

8. A method for decreasing the viscosity of a coal/water slurry containing agglomerated coal/oil masses which adversely affect the flowability of said slurry in a power generation system which comprises, adding an effective amount of at least about 0.2% by weight of an agglomeration-inhibiting agent selected from the group consisting of nonionic and anionic dispersing agents sufficient to soften and disperse said agglomerated coal/oil masses and thereby decrease the Brookfield viscosity of said mixture to less than about 50,000 cP and improve the flowability thereof into said power generation system.

9. The method of claim 8, wherein the coal/water slurry contains about 45% to 75% by weight of coal, wherein said coal has a particle size of less than about 300 microns and an ash content of less than about 5% by weight.

10. The method of claim 9, wherein said effective amount of agglomeration-inhibiting agent is selected from the group consisting of polysaccharides, ethoxylated nonylphenol and sodium lauryl sulfate.

11. The method of claim 9, wherein the coal/water slurry contains about 55% to 70% by weight of coal and wherein the particle size of the coal is less than 74 microns.

12. The method of claim 9, wherein the particle size of the coal is less than about 44 microns and wherein the ash content thereof is less than about 1%.

13. The method of claim 12, wherein the particle size of the coal is less than about 20 microns.

* * * * *